US005601361A

United States Patent [19]

Lawrence

[11] Patent Number: 5,601,361

[45] Date of Patent: Feb. 11, 1997

[54] CELEBRATION ELECTRIC LIGHT NET

[76] Inventor: Lonnie Lawrence, 3842 Kenwood, Odessa, Tex. 79762

[21] Appl. No.: 323,889

[22] Filed: Oct. 17, 1994

[51] Int. Cl.[6] ..... F21V 21/00

[52] U.S. Cl. ..... 362/238; 362/123; 362/249; 362/806

[58] Field of Search ..... 362/122, 123, 362/234, 238, 249, 250, 252, 253, 382, 806

[56] References Cited

U.S. PATENT DOCUMENTS

| | | | |
|---|---|---|---|
| 3,096,943 | 7/1963 | Forrer . | |
| 4,244,014 | 1/1981 | Van Ess | 362/249 |
| 4,335,422 | 6/1982 | Van Ess | 362/806 |
| 4,769,749 | 9/1988 | Felski | 362/252 |
| 5,213,409 | 5/1993 | Fisher . | |
| 5,213,519 | 5/1993 | Dorfman . | |
| 5,338,585 | 8/1994 | Fraus et al. | 362/123 |

*Primary Examiner*—Denise L. Gromada
*Assistant Examiner*—Y. Quach
*Attorney, Agent, or Firm*—Gunn & Associates, P.C.

[57] ABSTRACT

A movable and flexible net arranged in an M×N pattern is set forth. The pattern is defined by a plurality of parallel strands having eyelets therein to releasably engage and hold lamps in a light string. The net of the present disclosure, while supporting an attached light string, can be draped to any contour determined by a supportive surface, and can be likewise positioned in deployed pattern with that contour or stored for later use. The net in the M×N rectangular pattern is formed of flexible strands to enable storage.

20 Claims, 1 Drawing Sheet

FIG. 1
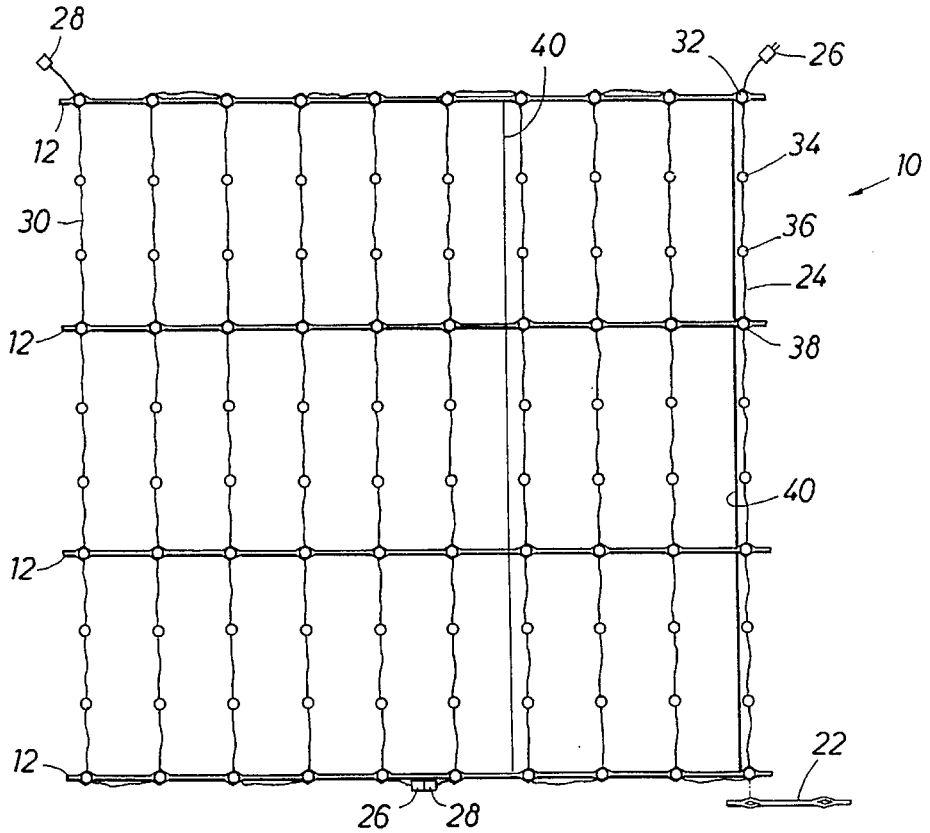
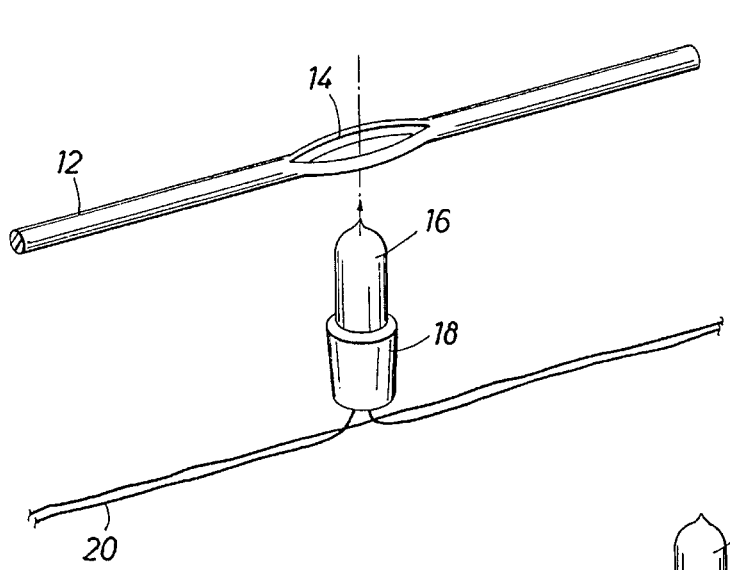
FIG. 2
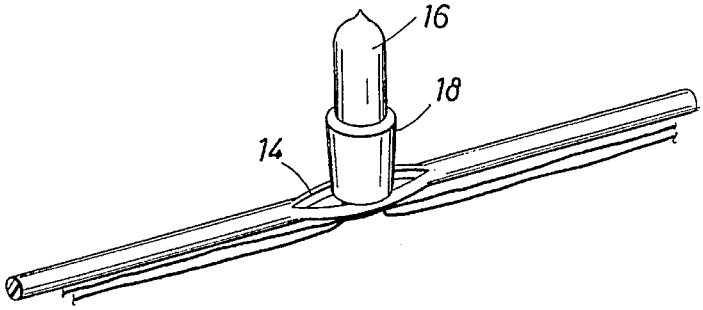
FIG. 3

CELEBRATION ELECTRIC LIGHT NET

BACKGROUND OF THE DISCLOSURE

The present disclosure is directed to a flexible material formed into a net. More specifically, it is formed of flexible material such as nylon or the like. The flexible material forms a net defining a replicated set of strands in a regular pattern. In a typical deployment of the present invention, the pattern is a square or rectangle which is replicated in a grid pattern of M×N to define a rectangular flexible net or sheet. The terms M and N refer to the number of replicated support strands thereby defining an open knit net having an overall rectangular shape which can then be draped or spread to any desired contour. It can be spread as a square, rectangle, or of the support shape. It enables one to organize and manage a long string of electric lights typically used at celebration seasons, one example being a string which is known as Christmas lights.

The present apparatus forms a supportive electric lamp prop which is not electrified. Rather, it has a fish net construction organized into the M×N pattern. With that pattern, a larger rectangular member is defined which is then easily draped over outdoor bushes, shrubs, trees, or indoor bushes, and Christmas trees. It can be draped over a Christmas tree of typical height thereby forming a cone shaped pattern. It can also be mounted on an overhead support or hung as a tapestry on a wall. The electric light prop of the present structure forms the supportive net, a term applied hereinbelow to the overall unit, a unit which has dimensions and shapes in accordance with the desired structure and shape of the present disclosure. The electric light net is typically used with a string of Christmas tree lights. That will be described hereinbelow as a light string. This typically is a purchased item having a plug at one end of the light string and a pair of conductors extending from socket to socket wherein the sockets mount small colored or transparent bulbs. This includes both the blinking and the constant illumination type bulbs. The light string provides the electrical power for operation of the several bulbs, it being understood that the light string is electrified while the net of the present disclosure is not electrified. Rather, the net is a mounting device which easily enables the light string to be installed, removed easily and thereafter stored.

The present disclosure thus forms a net which serves as a blanket which has an open weave and is therefore able to define a set of user selected openings for individual lamps in the light string. The individual lamps are all provided with electrical power from the light string itself. The lamp placement however is handled by the present invention. So to speak, it provides a regular rectangular grid of lamp mounting locations. The lamp mounting locations enable the several lamps to be positioned in a desired pattern. A light string, even one just removed from the box when purchased new, has no definitive illumination pattern. Rather, it simply furnishes a string of lamps which are electrified when provided with power. The present disclosure enables that set of individual lamps to be collectively arranged into an attractive pattern. When that has been accomplished, the pattern is then fixed because the placement of the light string from lamp to lamp is well determined. This is accomplished with the net of strands deployed in the rectangular member which is readily draped as mentioned.

BRIEF DESCRIPTION OF THE DISCLOSED APPARATUS

The present disclosure sets forth a support net formed of individual strands in an M×N pattern. The strands in the pattern form an organized system so that the net is able to be deployed over a supportive object with a light string connected to it comprising one or more individual lamps. This positions the lamps at desired locations. A pattern can then be formed, and the pattern is fixed even when the net is stored because the light string is caught in the net forming the desired pattern.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 1 shows the supportive net of the present disclosure and further includes an M×N rectangular pattern for supporting lamps in a light string which is connected in some desired pattern;

FIG. 2 shows how the net of the present disclosure supports an individual lamp with base which is inserted into a sized opening; and FIG. 3 is a view of the structure shown in FIG. 2 after the lamp has been inserted and grasped by the member making up the net.

DETAILED DESCRIPTION OF THE PREFERRED EMBODIMENT

Attention is now directed to FIG. 1 of the drawings where the numeral 10 identifies the net of the present disclosure. It is shown supporting one or more light strings which are connected together. The lights are arranged in a regular pattern so that the individual lamps on the light strings are spaced at regular locations. This will be more readily understood on review of the details describing the net 10 prior to assembly. Moreover, the assembled net 10 with the light string can then be deployed or stored as wished.

Describing first the net 10 devoid of the light string, the net 10 is formed of a set of parallel plastic lines such as the line 12 shown in FIG. 2 of the drawings. The line 12 is formed of a plastic material so that it will not conduct electricity. Typical materials are nylon, polyethylene, polypropylene, various copolymer systems or other flexible nonconductor strands. It is a relatively pliable strand but it is also preferably somewhat thick and stiff so that it can assume and hold a shape. The stiff strand 12 shown in FIG. 2 of the drawings typically has a diameter in the range of about 0.04 to about 0.09 inches. Preferably, it is either clear or colored green because the net 10 is typically draped over growing plants and the like and the strands therefore blend more readily when transparent or green. The strand 12 is formed with a tapered eyelet 14. The eyelet 14 is sized so that the width will fit over a lamp 16 and lamp base 18 in a light string 20. As noted, the term "light string" refers typically to a commercial bought string of Christmas lights. The lights typically are small, the bulbs being less than one-half inch in height. The base is typically about one quarter inch in diameter and has a height of less than ½ inch. The light string 20 typically comprises a number of individual lamps, each provided with a base, which are deployed at regular spacing from lamp to lamp. A common spacing is typically about 6 inches. Quite obviously, that distance is a manufacturing convenience for the vendor of light strings and is not intended to be a specific limitation on the present disclosure. In other words, the spacing from lamp to lamp can be altered readily. The spacing from lamp to lamp is easily modified so that different light strings 20 from different manufacturers can be used. It is assumed in the present disclosure that the lamps 16 and the bases in the light string 20 have common dimensions. The eyelet 14 is sized so that it will snap back after it has been pressed over the base 18. When it snaps back, it clamps the base and holds the light string 20 next to the strand 12. This is repeated for several eyelets 14 in conjunction with some or perhaps all of the lamps and related bases in the light string 20. More will be noted regarding that pattern hereinafter.

Going back now to FIG. 1 of the drawings, the numeral 12 identifies the strand described with regard to FIG. 2 of the drawings. In FIG. 1, there are several such parallel strands. They are arranged parallel to each other and typically have a common length. Moreover, the several strands are deployed in the net 10 which enables the attachment of the light string 20 as will be described. If desired, an individual strand 12 making up the net 10 can be formed as a unitary member of great length; alternatively, a splice can be accomplished. A splice is depicted at the lower right corner of FIG. 1 where a similar strand 22 is shown. In it, the eyelets 14 are spaced at the same spacing as the strands 12. The strand 22 is installed at one or two eyelets pressed over the lamps and lamp bases so that the strand 22 is overlapping with the adjacent strand 12. This can be used to extend an individual strand 12 or alternately to extend any number of the strand 12.

Continuing in FIG. 1 of the drawings, the net system 10 preferably supports the light string which extends from strand to strand. More specifically, a first light string 24 is indicated in FIG. 1 of the drawings and terminates at a plug 26. This enables electrical power to be obtained. In this particular instance, the light string 24 is relatively long and terminates at a mating socket 28 which is then connected with another plug 26. This connects two light strings together. The second light string is identified generally by the numeral 30 and terminates at its remote end with another socket 28 at the upper left corner of FIG. 1. In this deployment, two individual light strings 24 and 30 are serially connected through the plug and socket connection just mentioned so that the two lights strings together forms one light string 20.

In another aspect of the present disclosure, the first light string 24 includes a first bulb 32, a second bulb 34, a third bulb 36 and a fourth bulb 38. These bulbs are located in series with equal spacing. The first of the lamps 32 is nearest the plug 26.

The light string 20 is arranged at right angles with respect to the several strands 12. As will be understood, strand spacing is a scale as shown here, namely, the positioning of the strand 12 to support the first lamp 32, and also the second strand 12 which connects with the fourth lamp 38. The two strands 12 therefore connect at the first and fourth lamps. As will be understood, the spacing from strand to strand can be varied. This is a scale factor which is determined by the user at the time of installing the light string 20 on the net 10.

In one aspect of the present disclosure, the light string 20 can be arranged either parallel or at right angles with respect to the strand 12. In FIG. 3 of the drawings, the lamp 16 and related base 18 are shown after pressing through the eyelet 14. This enables the individual lamp to be captured, and when that has been done for several lamps 16 in a light string 20, the entire light string becomes constrained dependent on the pattern of capture. In this particular instance, the preferred embodiment 10 shown in FIG. 1 of the drawings utilizes the horizontally illustrated strands 12. In addition, the net 10 includes in the preferred embodiment a transverse connective strand 40 which has been illustrated immediately adjacent to the lamps 32, 34, 36 and 38. The replicated transverse strand 40 does not have eyelets; rather, it simply is a spacer. As will be understood, because the transverse strands 40 are made of flexible material, it is not a rigid spacer. The several spacers 40 connect to the strands 12 extending at right angles. Because of that, it operates best as a spacer when the net is deployed. As will be observed, in a substantial fashion, spacing is also accomplished by the light string 20 which is positioned in the desired locations on the net 20.

TYPICAL LIGHT STRING INSTALLATION

A light string is formed of several strings 24 and 30 which are serially connected and installed in the net 10 in some desired geometric pattern. Such a pattern typically involves design of the pattern so that the flexible net supports the flexible light string 20 in the desired pattern. A regular rectangular pattern is shown in FIG. 1. That is not the limit of patterns which can be implemented with the net 10 and the light string 20. Typically, the net is deployed on a flat working area. A desired pattern is then determined for the net 10. In a desired pattern, the light string can be laid loosely over the net. Thereafter, beginning at one end or the other of the light string, the individual lamps are pushed through adjacent eyelets. The eyelets are engaged with the lamps so that the eyelets are able to hold the entire light string 20. This may involve positioning the electrical conductor in some resultant pattern. The desired pattern may involve placing all of the lamps in particular eyelets or some but fewer than all of the lamps. In the specific rectangular grid shown in FIG. 1, fewer than half of the lamps are installed in eyelets. Even so, the pattern shown in FIG. 1 is a fixed pattern because a number of lamps are constrained in position by anchoring to the various strands 12. The pattern is limited primarily by the imagination of the user. The pattern can be any pattern that is appropriate for the net 10.

The net 10 is normally handled resting on a floor or other work surface. The installation of the light string 20 typically occurs at that stage. Thereafter, the net 10 which carries in it several lamps sufficient to support the light string 20 is draped over a shrub, bush and especially over a Christmas tree. At this time, the net 10 takes on the contour or shape of the support structure, and because the light string is attached to the net 10, the light string also necessarily takes on the contour or shape of the support structure. So to speak, the light string 20 becomes multiple points of light on the surface of the supportive structure. This is especially useful with a Christmas tree. If random positioning is used, and no particular pattern is required for the Christmas tree, the net 10 can be spread over the floor, the lamps installed in the net and then the net supporting the lamps is placed on the Christmas tree. This will provide a random scatter of lamps at various places on the exterior of the Christmas tree assumed to be a typical cone shaped tree. Quite obviously, the shape of the tree may vary which will therefore vary the position of the many lamps on the contour of the Christmas tree.

It may be necessary to use an extension cord to reach the light string 20. Recalling that the light string is formed of one or more connected light strings, it maybe necessary to serially connect an extension cord from an electrical fixture extending to the net 10 for connection with the light string 20. If desired, the light string 20 can be a singular set of lamps connected serially as mentioned before, or indeed, if desired, the extension cord can connect with two or more light strings which are connected in parallel. Without regard to the particulars of the electrical connection the net 10 provides the support function to the light string 20 so that the deployed lamps on the tree can be readily handled.

Going now to other aspects of the present disclosure, it is noteworthy that the length and width of the assembled net is a scale factor. If the Christmas tree is approximately six feet in height, and approximately one foot is the trunk of the tree without limbs, the net preferably has a height of about five feet. Indeed, even four feet will suffice depending on the manner of draping the net 10 over the Christmas tree, a structure which is assumed to be more or less conic in shape. This can be done with clear or transparent lamps or can be done with colored lamps, both of those of constant illumination and those which blink. After the light string 20 has been installed on the net 10, the net can be deployed over the tree at the start of the Christmas season and thereafter removed and stored until the next year without disassembly. Likewise, this can be used to advantage for any season of the year in which decorative lamps are involved.

While the foregoing is directed to the preferred embodiment, the scope thereof is determined by the claims which follow.

I claim:

1. A supportive net for a light string wherein the light string comprises multiple decorative lamps where each lamp is supported in a lamp base and the lamp bases are connected on a power providing cable, the supportive net comprising:

(a) a plurality of strands having spaced eyelets, each of said eyelets arranged to releasably connect to and hold a light string lamp to position the lamp in a desired pattern defined by the supportive net;

(b) said net defined by at least two parallel strands, and each strand including at least one eyelet receiving and supporting one of said multiple decorative lamps of the light string;

(c) a plurality of transverse connective strands connect said two parallel strands, and said transverse connective strands serve as spacers between eyelets contained only in said parallel strands; and (d) wherein said at least two parallel strands and said transverse connective strands define an M×N open weave net where M and N represent the number of strands and spacers in said net.

2. The supportive net of claim 1 wherein said parallel strands are pliable so that said eyelets flex open and enable lamps and bases of the light string to be supported thereby.

3. The supportive net of claim 2 wherein each of said eyelets is sized to pass over said lamp and said lamp base to thereafter hold said lamp at a fixed location relative to said net.

4. The supportive net of claim 3 wherein each of said eyelets is formed as an elongate opening in said strand to fit over the lamp base of about ¼ inch in diameter.

5. The supportive net of claim 4 wherein said net is extended by placing at least one unconnected strand having an eyelet therein over the lamp and the lamp base so that said lamp base are captured by two separate strands.

6. The supportive net of claim 5 wherein said unconnected strand has at least two spaced eyelets therein.

7. The supportive net of claim 4 wherein some but not all the lamps in the light string are engaged in the eyelets of the supportive net, orienting the light string to the contour of said net.

8. The supportive net of claim 7 wherein said light string ends at an electrical connector and said net holds said electrical connector at a fixed location so that said electrical connector can be electrically connected to illuminate said lamps.

9. The supportive net of claim 1 wherein said strands comprise a portion of said light string.

10. A flexible support for a plurality of lights, comprising:

(a) substantially parallel strands wherein said parallel strands are flexible;

(b) eyelets in each of said parallel strands for releasably attaching individual lights of said plurality of lights;

(c) transverse strands attached to said parallel strands spacing apart the eyelets contained only in said parallel strands; and (d) said parallel strands and said transverse strands forming a grid.

11. The flexible support of claim 10 wherein said strands are nonconductive.

12. The flexible support of claim 10 wherein said eyelets are longitudinal slits in said parallel strands.

13. The flexible support of claim 10 wherein said parallel strands connect to a plurality of spaced lights.

14. The flexible support of claim 10 wherein each of said parallel strands comprises uniform two-ended connective links having eyelets thereon.

15. A supportive pliable support for orienting lights connected together by an electrical cable, wherein the orientation of said lights is on the surface of said supportive pliable support, and the supportive pliable support comprises:

(a) at least two strands, said strands being pliable and substantially parallel to each other;

(b) securing means to secure said lights supported on said strands; and (c) at least two transverse strands, said strands being pliable and substantially parallel to each other, said transverse strands, spacing apart the securing means contained only in said parallel strands, are connected transversely to said parallel strands forming an open weave supportive pliable support.

16. The supportive pliable support of claim 15 further comprising means to connect said supportive pliable support with a second supportive pliable support and means to connect said second supportive pliable support with a third supportive pliable support.

17. The supportive pliable support of claim 16, said second supportive pliable support having four sides, further comprising means to connect said second supportive pliable support with a fourth supportive pliable support and means to connect said second supportive pliable support with a fifth supportive pliable support, so that said second supportive pliable support may be connected to another supportive pliable support on each of said four sides.

18. The supportive pliable support of claim 15 wherein said electrical cable has a plurality of bases for engaging said lights and said securing are sized to releasably secure said bases.

19. The supportive pliable support of claim 15 wherein said strands comprise an electric cable connecting said lights with electric power for illumination.

20. The support of claim 19 including one of a plug and a socket connector in said electric cable.

* * * * *